US005260505A

United States Patent [19]

Kendall

[11] Patent Number: 5,260,505

[45] Date of Patent: Nov. 9, 1993

[54] REVERSING AND PREVENTING WARPAGE IN STRINGED MUSICAL INSTRUMENTS

[76] Inventor: Donald W. Kendall, P.O. Box 5764, Roswell, N. Mex. 88202

[21] Appl. No.: 817,931

[22] Filed: Jan. 6, 1992

[51] Int. Cl.[5] ..... G10D 3/04

[52] U.S. Cl. ..... 84/298; 84/299; 84/307

[58] Field of Search ..... 84/291, 297 R, 298, 84/299, 200, 202, 307, 308, 309

[56] References Cited

U.S. PATENT DOCUMENTS

| | | | |
|---|---|---|---|
| 10,934 | 5/1854 | Towers | 84/298 |
| 476,907 | 6/1892 | Tibbits | 84/275 |
| 519,416 | 5/1894 | Turner | 84/299 |
| 638,154 | 11/1899 | Walker | 84/201 |
| 1,116,754 | 11/1914 | Storle | 84/294 |
| 1,128,217 | 2/1915 | Bohmann | 84/295 |
| 1,214,075 | 1/1917 | Rice | 84/295 |
| 1,317,089 | 9/1919 | Maine et al. | 84/275 |
| 1,890,861 | 12/1932 | Overton | 84/267 |
| 2,473,980 | 6/1949 | Willner | 84/295 |
| 2,588,440 | 12/1949 | Warren et al. | 84/201 |
| 3,853,031 | 12/1974 | DeWitt et al. | 84/267 |
| 4,026,181 | 5/1977 | Barcus et al. | 84/291 |
| 4,206,678 | 6/1980 | Guerrero | 84/267 |
| 4,253,371 | 3/1981 | Guice | 84/267 |
| 4,509,399 | 4/1985 | McKibben | 84/297 R X |
| 4,809,579 | 3/1989 | Maccaferri | 84/293 |
| 4,843,941 | 7/1989 | Nichols et al. | 83/313 |
| 4,872,388 | 10/1989 | Gunn | 84/297 R |
| 4,932,302 | 6/1990 | Saijo | 84/313 |
| 4,939,971 | 7/1990 | Satoh | 84/313 |
| 4,951,543 | 8/1990 | Cipriani | 84/298 |
| 4,953,435 | 9/1990 | Chapman | 84/293 |

FOREIGN PATENT DOCUMENTS

| | | | |
|---|---|---|---|
| 2831920 | 5/1979 | Spain | 84/291 |

*Primary Examiner*—Michael L. Gellner
*Assistant Examiner*—P. Stanzione
*Attorney, Agent, or Firm*—Rod D. Baker; Deborah A. Peacock

[57] ABSTRACT

The invention relates to apparatuses, and methods for their use, for reversing or preventing warpage in the top plates of guitars and similar musical instruments attributable to the tensile forces within the strings of such instruments. The apparatus employs a compression block attached within the interior of an instrument's sound box, upon the interior side of the top plate and opposite the bridge, a compression rod between the compression block and the tail block of the instrument, and means within the interior of the sound box for adjusting the movement of the compression rod. When installed, the apparatus of the invention may be manipulated to induce a compressive force upon the interior side of the instrument's top plate, thus arresting or reversing the undesirable warpage in the top plate caused by the tension in the instrument's strings.

27 Claims, 4 Drawing Sheets

REVERSING AND PREVENTING WARPAGE IN STRINGED MUSICAL INSTRUMENTS

BACKGROUND OF THE INVENTION

1. Field of the Invention (Technical Field)

This invention relates to apparatuses for reversing and preventing warpage in the top plates of stringed musical instruments, a string pin, and methods for their use.

2. Description of the Related Art

There is a need for a simple, inexpensive means for preventing warpage in the top plates of stringed musical instruments, and for reversing or correcting such warpage when it occurs. Warpage of top plates is most frequently the result of the deformative forces caused by the sustained tension in the instrument's strings. The apparatus of the present invention provides the means for creating an adjustable force opposing the deformative force of the strings. Through the adjustment of the opposing force created by the apparatus, the deformative force of the strings can be neutralized, thereby preventing or reversing undesirable warpage.

The apparatus may be built into the musical instrument at the time of the instrument's manufacture, or may later be installed by the musician or other user. The application of the invention at the time of manufacture has the purpose of preventing top plate warpage before it has opportunity to occur. A more pressing need for the invention, however, exists among present owners of instruments, owners wishing to prevent warpage in their instruments or wishing to remedy warpage that has already occurred. The preferred embodiment of the invention will find immediate application in this "after-market" of existing instrument owners.

Efforts have been made by others to address the problems caused by, or related to, the tension in the strings of stringed musical instruments. U.S. Pat. No. 519,416 to Turner discloses a device that must be installed within guitars at the time of the instrument's manufacture. The device described in the patent to Turner is much more complicated than the apparatus of the present invention and is mechanically distinguishable therefrom. The device described in the '416 patent to Turner attempts to isolate, rather than counteract, detrimental string tension. The apparatus requires that two large holes be placed in the top plate, which adversely impacts the acoustics of the instrument.

U.S. Pat. No. 1,116,754 to Storle shows a device used exclusively within violins. The '754 patent to Storle describes an elbow-shaped lever to be fitted within the interior of violins to replace the standard violin bass bar, which base bar counteracts the inward pressure of the violin strings. The Storle invention is mechanically very dissimilar from the present invention, and evidently must be installed in the violin at the time the instrument is manufactured.

U.S. Pat. No. 4,206,678 to Guerrero describes a device for use in stringed instruments for the purpose of counteracting the deforming forces of the string tension. The '678 patent discloses various embodiments of an apparatus which must be incorporated within the instrument at the time of its manufacture, and thus lacks the portability of the present invention. Moreover, the various Guerrero apparatuses typically require adjustment mechanisms on the exterior of the guitar, where they are subject to unintentional manipulation and where they mar the traditional appearance, and possibly sound, of the instrument.

U.S. Pat. No. 4,253,371 to Guice describes a bridge apparatus for use in stringed instruments that can only be installed at the time of manufacture or after severe modification of an existing instrument. The apparatus described in the '371 patent is patterned somewhat after the device disclosed in the '416 patent, but with an attempt made to overcome the difficulties of the Turner device. But like the Turner apparatus, the Guice invention is bulky and non-portable.

U.S. Pat. No. 4,951,543 to Cipriani describes a bridge apparatus which object is to improve the volume of acoustical guitars by allowing an increase in string tension without altering string length. Unlike the present invention, the Cipriani apparatus is attached nearly entirely outside the sound box of the guitar.

SUMMARY OF THE INVENTION (DISCLOSURE OF THE INVENTION)

This invention relates to embodiments of an apparatus for reversing and preventing warping in top plates of stringed musical instruments, a string pin, and methods for their use. The apparatus comprises a compression block, means for attaching the compression block to the interior side of the top plate of the instrument, a compression rod moveably disposed between the compression block and the tail block of the instrument, means for directing the contact between the compression rod and the compression block, and means for adjusting the movement of the compression rod. The compression block preferably comprises a parallelepiped having a rhomboid vertical cross section, and preferably comprises a sturdy, elastic material. The compression block preferably also comprises one or more string pin openings to receive string pins, and one or more compression slots to foster added lateral flexibility in the compression block.

The apparatus of the invention also comprises means for attaching the compression block to the interior side of an instrument's top plate. Preferably, the attaching means permits removable attachment, and thus preferably comprises at least one removably insertable string pin.

Between the compression block of the apparatus and the tail block of the instrument and contacting both, is disposed a compression rod. The rod's contact with the compression block preferably is directed by a guide tube mounted within the compression block. A ball bearing preferably is inserted within the guide tube, followed by the sliding insertion of the compression rod into the guide tube.

The apparatus also comprises means, preferably an adjustment screw, for inducing compression in the compression rod and compression block. Preferably, the adjustment screw is turned through the compression block and into the guide tube, where it contacts the ball bearing which in turn contacts the compression rod. The careful manipulation of the adjustment screw results in compression forces being induced within the compression rod and the compression block, which results in the imposition of an outward force upon the interior face of the top plate, which force corrects or prevents undesirable warping of the top plate.

The present invention also comprises a specialized string pin particularly useful in the apparatus of the invention. The string pin, preferably fashioned of brass, comprises a cylindrical head with two string holes drilled or otherwise formed therethrough. The string holes are along perpendicular diameters of the cylindrical head of the string pin, and permit the use of tools for turning the string pin, as well as permitting attachment of the instrument's string to the string pin.

The present invention also comprises methods and manners of preventing and reversing warpage in the top plates of musical instruments as will be described and claimed hereinafter.

While the invention of the following description has express application to acoustical guitars, it shall be apparent to those of ordinary skill in the art that the invention may be beneficially practiced, perhaps with minor adaptations, on other stringed instruments.

It is a primary object of the present invention to provide an apparatus which easily and quickly corrects or arrests warpage in top plates of stringed musical instruments.

It is a further object of the present invention to provide a simple, inexpensive apparatus for correcting or arresting warpage in top plates of stringed musical instruments.

It is another object of the present invention to provide an apparatus for correcting or arresting warpage in top plates of stringed musical instruments that need not necessarily be installed at the time the instrument is manufactured.

It is another object of the present invention to provide an apparatus for correcting or arresting warpage in top plates of stringed musical instruments which is removably attachable, and thus portable from one instrument to another.

It is another object of the present invention to provide an apparatus for correcting or arresting warpage in top plates of stringed musical instruments which is installed almost entirely within the interior of the instrument, and thus does not distract from the appearance of the instrument.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized an attained by means of the instrumentalities and combinations particularly pointed out in the appended claims.

DESCRIPTION OF THE PREFERRED EMBODIMENT (BEST MODE FOR CARRYING OUT THE INVENTION)

It has been for decades, perhaps centuries, a matter of common knowledge in the art that the constant tension in the strings of stringed musical instruments causes undesirable warpage in the top plates of those instruments. It is the object of this application to describe a simple, inexpensive solution to the problem, rather than to extensively elaborate upon the nature of the problem. Accordingly, a detailed discussion of the problem shall not be undertaken here; instead, only such explanation as may be needed to understand the purpose and practice of the present invention shall be offered.

Figure 6:
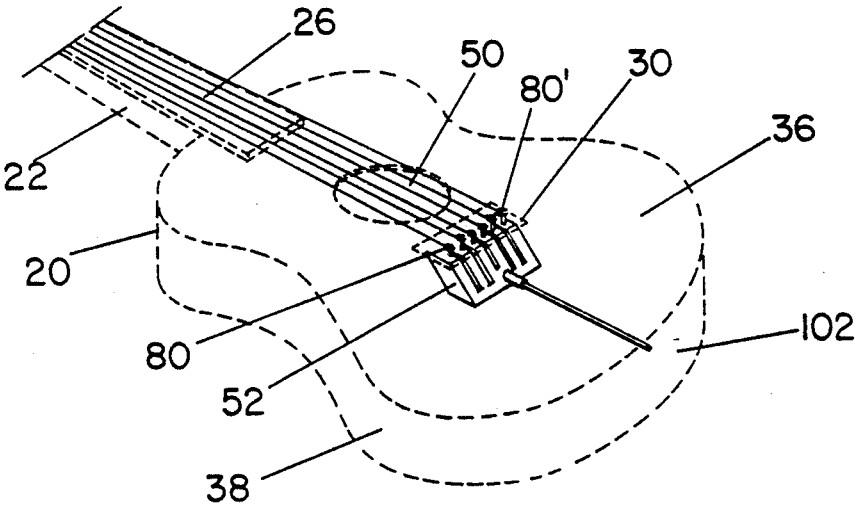
FIG. 6 is a schematic view of the preferred embodiment of the apparatus of the invention, showing the functional relative placement of the apparatus within the interior of an acoustical guitar.
Figure 8:
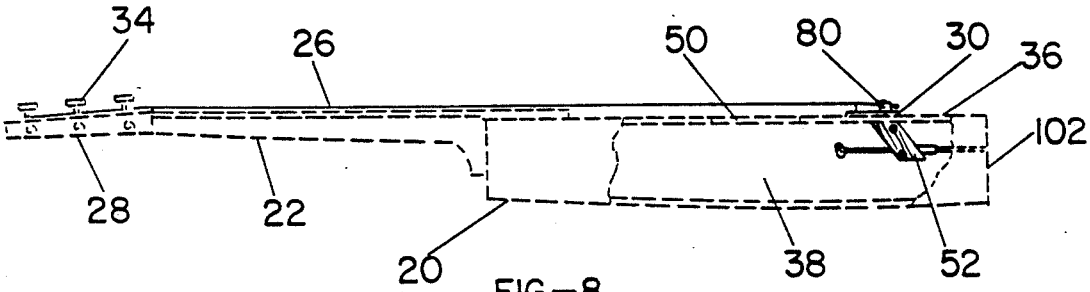
FIG. 8 is a side view of an acoustical guitar with a portion of the side of the guitar sound box broken away to show the functional application of the apparatus of the invention within the interior thereof.

Reference is now made to FIGS. 6 and 8. Those of ordinary skill in the art know that a typical acoustical guitar includes a body 20 from which extends a fret board 22. Positioned upon the fret board 22 is a plurality of strings 26, extending between the head 28 of the guitar and a bridge shown generally at 30. The strings 26 are removably attached to the bridge and to tuning keys 34 located on head 28. Strings 26 are drawn into tension, which tension is adjustable by the use of tuning keys 34. The body 20 of the instrument, which has special acoustical properties, includes the top plate 36, often referred to in the art as the "cover" or "sound board," and the sound box 38. A musician's plucking of strings 26 causes them to vibrate, which vibrations are imparted to top plate 36 via the bridge at 30, as shall be shown in more detail later. The vibration of top plate 36 and sound box 38 result in the pleasant music of the instrument. Most guitars also have a planar bridge plate (not shown) attached to the interior surface of top plate 36, immediately beneath or in the vicinity of the bridge at 30. For purposes of clarity, the bridge plate has been omitted from the drawings, and as it plays no substantial role in the practicing of the invention, shall not be further discussed.

Figure 9:
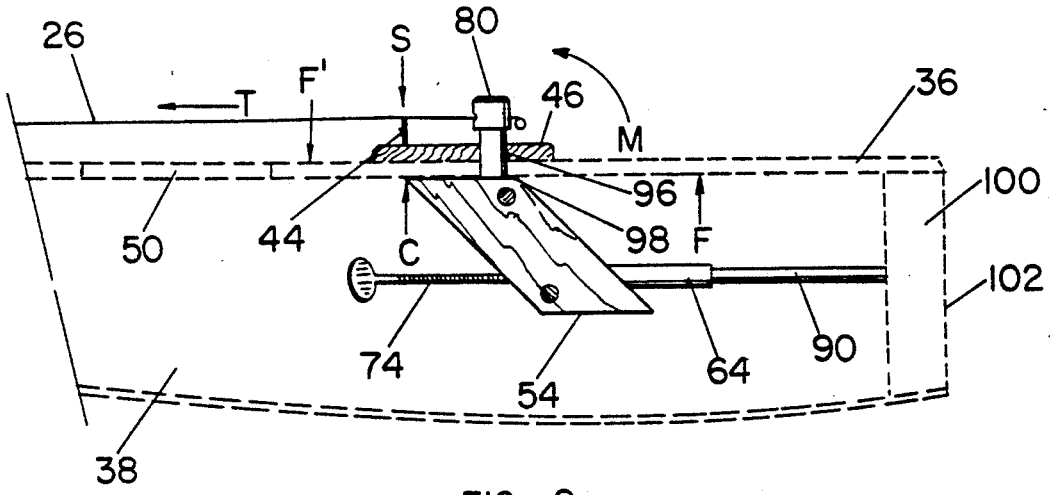
FIG. 9 is a schematic sectional view of the side of the sound box of an acoustical guitar, showing the functional position of the preferred embodiment of the apparatus of the invention within the soundbox.

FIG. 9 illustrates in some detail certain of the working elements of a typical guitar. As mentioned, strings 26 (only one shown) are stretched into tension and attached to string pins 80, 80' (only one shown). Strings 26 contact, but are not attached to, saddle 44. When the instrument is in use, vibrations of strings 26 are communicated directly to the bridge 46 by the saddle 44. Bridge 46 is permanently affixed to top plate 36. The resulting vibration of bridge 46 in turn causes vibration of top plate 36, which results in the sounding of the instrument through the sound box 38.

With continued reference to FIG. 9, it is observed that the tension in each string 26 causes tension force T to be exerted upon string pin 80, and a related, but considerably lesser, compression force S downward upon saddle 44. It is seen that the combination of forces T and S results in a rotational moment of force M tending to act generally about the vicinity where string pin 80 contacts bridge 46. Moment of force M acts upon top plate 36 via bridge 46. The detrimental effects of moment of force M can best be visualized by transforming moment of force M into an equivalent couple of forces F and F' acting directly upon top plate 36. Forces F and F', when imposed over the lengthy periods of time during which string 26 is in tension, cause warpage in top plate 36. Usually, top plate 36 tends to warp outwardly from body 20 in the vicinity of force F, and inwardly in the vicinity of force F'. This warpage can be unsightly; but much more importantly, it inevitably impedes the proper vibration of top plate 36, with a corresponding adverse impact upon the acoustical qualities of the instrument. It is the purpose of the present invention to prevent, arrest, or reverse the undesirable effects upon the instrument of the tension force T as described.

A very general understanding of the invention may be had with reference to FIGS. 6 and 8, which show a preferred embodiment of the invention functionally attached to an acoustic guitar. The complete apparatus of the invention, labelled 52, is installed substantially within the interior of sound box 38. Installation of complete apparatus 52 requires the detachment of strings 26 from string pins 80, 80'. With strings 26 thus removed, access to the interior of sound box 38 may be had via sound hole 50, thus allowing the insertion and installation of apparatus 52 within the interior.

Figure 1:
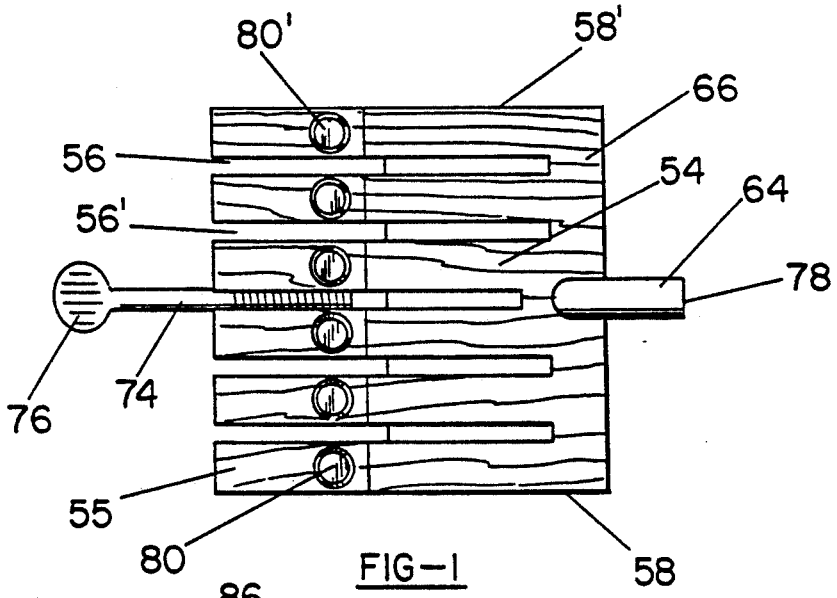
FIG. 1 is an isometric view of the top of the preferred embodiment of the apparatus of the invention.
Figure 2:
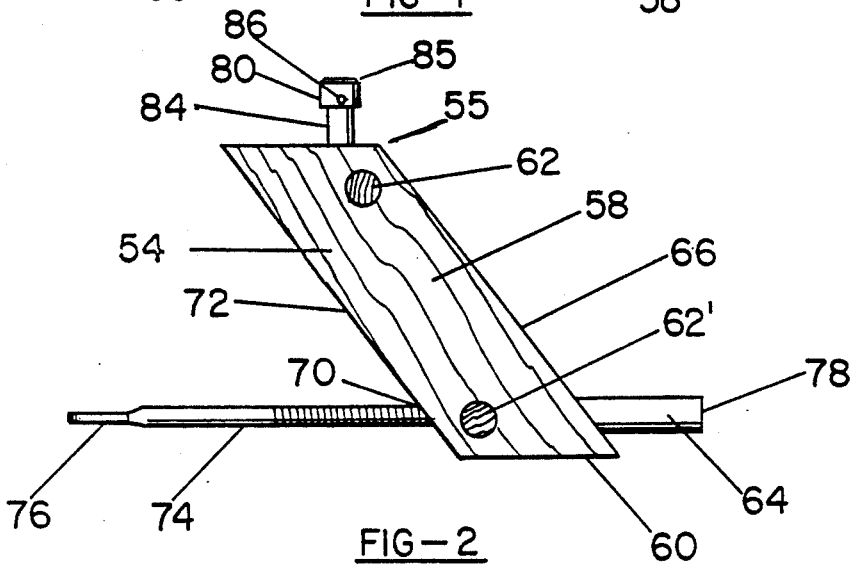
FIG. 2 is an isometric view of the side of the FIG. 1 embodiment.

Reference is now made to FIGS. 1-5, showing various views of a principal portion of a preferred embodiment of the apparatus. Compression block 54 is preferably composed of any durable lightweight material, such as wood; experience indicates that pinewood, due to its low cost and workability, is well-suited as a compression block material. It is preferred that the material of compression block 54 also have some flexible elasticity, also a virtue of pinewood. Compression block 54 preferably is a parallelepiped, and, as seen in FIG. 2, has a rhomboid vertical section.

Figure 3:
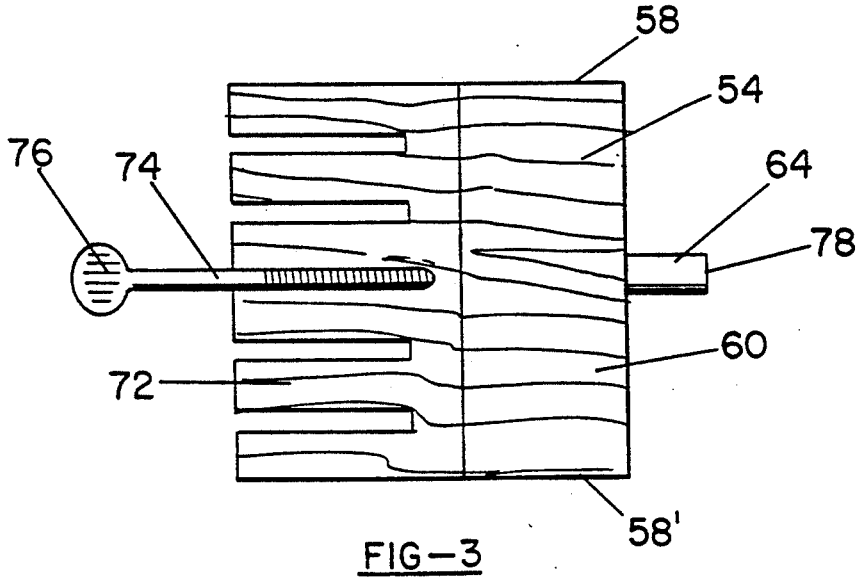
FIG. 3 is an isometric view of the bottom of the FIG. 1 embodiment.
Figure 4:
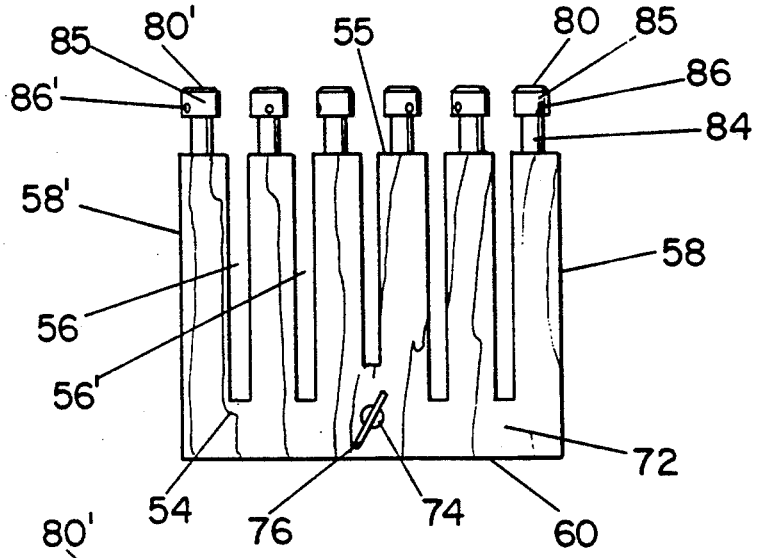
FIG. 4 is an isometric view of the front of the FIG. 1 embodiment.

As more particularly observed in FIG. 1, FIG. 3 and FIG. 4, compression block 54 is partially transected by compression slots 56, 56'. Compression slots 56, 56' are one or more in number; in the preferred embodiment of the apparatus, intended for use in a six-string guitar, they number five. Compression slots 56, 56' are parallel and uniformly spaced at regular intervals along the width of compression block 54. Compression slots 56, 56' partially transect compression block 54 vertically and parallel to its sides 58, 58', penetrating and completely transecting its top 55. Compression slots 56, 56' do not completely transect compression block 54, leaving an unsevered portion along bottom 60 to maintain the integrity and strength of the compression block 54. In the preferred embodiment, compression slots 56, 56' are cut into compression block 54 using a saw. In the event compression block 54 is fashioned of pinewood or any material tending to split easily, the cutting of compression slots 56, 56' may be preceded by the insertion of one or more horizontal reinforcing dowels 62, 62', using dowelling techniques common in the woodworking art. Reinforcing dowels 62, 62' would then be transected by compression slots 56, 56' as though the dowels were an integral part of compression block 54.

Having reference to FIGS. 1-5, it is noted that compression block 54 is fitted with guide tube 64. Guide tube 64 is a hollow tube, preferably composed of aluminum or other metal, having a length approximately equal to the length of bottom 60 of compression block 54. The outside diameter of guide tube 64, while not critical, preferably is approximately one-fourth the tube's length. The wall thickness of guide tube 64 is sufficient to allow guide tube 64 to bear substantial compressive loads and torques without kinking, crimping or bending. Guide tube 64 is fixed within the portion of compression block 54 (near its bottom 60) not transected by compression slots 56, 56'. As illustrated in FIGS. 1 and 4, any one or more compression slots 56, 56' located at or near the center of the width of compression block 54 may be abbreviated in depth, relative to other compression slots, so as to more readily accommodate the attachment of guide tube 64.

Guide tube 64 is permanently mounted within compression block 54, preferably by a drill and glue technique. A hole with a diameter approximately equal to the outside diameter of guide tube 64 is drilled or otherwise formed into the back 66 of compression block 54 near its bottom 60. The hole is drilled as near the center of the width of compression block 54 as possible. The hole is drilled parallel to sides 58, 58' to a depth of approximately one-half the length of the bottom 60 of compression block 54. Guide tube 64, with glue as needed, is then inserted into the resulting hole until it bottoms and is well seated. As the length of guide tube 64 approximates the length of compression block 54, approximately one-half the length of the fully inserted guide tube thus remains protruding from the back 66 of compression block 54, as seen in FIGS. 1 and 2.

Figure 5:
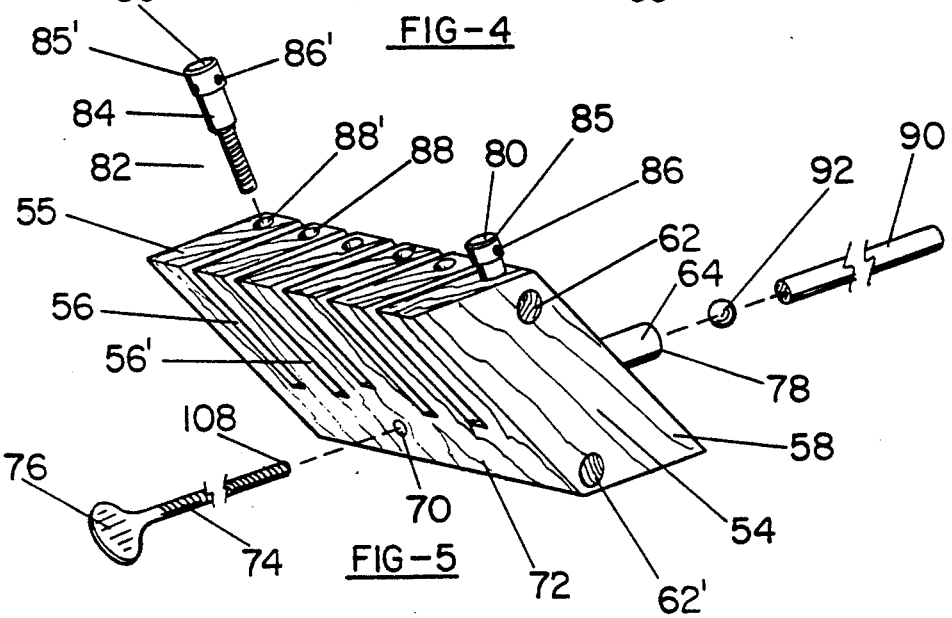
FIG. 5 is an exploded perspective view of the front of the preferred embodiment of the apparatus of the invention, showing the positional relationship of various elements of the embodiment.

Reference is now made to FIG. 5, which shows screw opening 70. Screw opening 70 is drilled or otherwise formed into the front 72 of compression block 54, in the vicinity of its bottom 60, and at the center of its width. Screw opening 70 has a diameter approximately equal to the inside diameter of the threaded portion of adjustment screw 74, such that adjustment screw 74 may be removably, yet securely, screwed by hand into screw opening 70. Screw opening 70 is drilled in the location which causes its longitudinal axis to be collinear with the longitudinal axis of guide tube 64. Screw opening 70 is drilled or otherwise formed into compression block 54 until screw opening 70 opens up into the interior end of guide tube 64. Thus, when completely installed, screw opening 70 and guide tube 64 actually comprise a single tunnel piercing compression block 54 from front 72 to back 66, said tunnel having different diameters for each half of its length: the diameter of screw opening 70 for the half-length nearest front 72, and the diameter of guide tube 64 for the half-length nearest back 66.

Reference is now made to FIGS. 1-5, illustrating the positioning of adjustment screw 74. Adjustment screw 74 is a screw, preferably composed of lightweight metal, and in the preferred embodiment is threaded for use in wood. Adjustment screw 74 preferably has a flanged head 76 to permit the easy turning of adjustment screw 74 with human fingers, but also may have any type of head permitting the use of a small tool, such as a screwdriver, for turning. Adjustment screw 74 is installed upon compression block 54 by turning adjustment screw 74 into screw opening 70, such that the threads of adjustment screw bite and hold the material of compression block 54 along the length of screw opening 70. Adjustment screw 74 preferably is threaded throughout its length.

As most readily observed in FIGS. 2 and 3, an adjustment screw of sufficient length could be turned through the length of screw opening 70, emerge into the interior of guide tube 64 (where the screw threads would no longer contact compression block 54), and be turned through the length of guide tube 64 as well, eventually appearing at the exterior end 78 of guide tube 64. Indeed, adjustment screw 74 preferably is of sufficient length to permit it to be turned through the combined lengths of screw opening 70 and guide tube 64, while still allowing sufficient screw length protruding from front 72 of compression block 54 to facilitate manual manipulation of the adjustment screw 74 by its flanged head 76.

FIG. 5 illustrates the installation of string pins 80, 80' into compression block 54. Sting pins 80, 80' may be one or more in number, one for each string of the instrument; in the preferred embodiment they number six for six-stringed instruments. String pins 80, 80' are composed of any durable material, preferably brass. String pins 80, 80' have threads 82 suitable for screwing in the material of compression block 54, and also nonthreaded shank 84 with a length approximately one-fifth the overall length of string pin 80.

String pins 80, 80' each have cylindrical heads 85, 85' which are pierced along their perpendicular diameters by two horizontal string holes 86, 86'. String holes 86, 86' may be described as small circular tunnels, perpendicular to each other, that intersect at the center of the cylindrical head 85 of each string pin 80. String holes 86, 86' completely transect cylindrical heads 85, 85', and thus create four small apertures at regular ninety-degree intervals about the circumferences of cylindrical heads 85, 85'. String holes 86, 86' are parallel to the tops of cylindrical heads 85, 85'; accordingly, when string pins 80, 80' are installed as hereinafter described, string holes 86, 86' will be parallel to top plate 36.

At least one of string holes 86, 86' preferably has a diameter only slightly larger than the diameter of the guitar string corresponding to the particular string pin 80. Thus, by way of example but not by limitation, a six-string guitar shall have six string pins 80, 80', with no two string pins having string holes 86, 86' of the same diameter. Rather, one of the string pins 80, 80' will have string holes 86 or 86' of a relatively large diameter to accommodate a large-diameter bass string, while the other five string pins 80, 80' will have smaller-diameter string holes 86 or 86' to receive the correspondingly and progressively smaller-diameter strings pertaining to the tenor and/or alto pitches.

It shall be understood that only one string hole 86 per each string pin 80 ordinarily need receive a string 26 when the present invention is practiced. The particular string 26 pertaining to the given string pin 80 is inserted through one of the string holes 86 or 86' in the pin's cylindrical head 85, and then is secured using a string ball or other securing means common in the art. The sister string hole not containing a string 26 may then be utilized to assist in the screwing of string pin 80 into compression block 54 as hereafter described. The unfilled string hole could, for example, accommodate a minute rod or wire to increase the turning leverage on string pin 80.

Having further reference to FIG. 5, it is seen that string pins 80, 80' are screwed into pin holes 88, 88' in compression block 54. As illustrated in FIGS. 1, 2, 4 and 5, pin holes 88, 88' are drilled or otherwise formed in the top 55 of compression block 54. Pin holes 88, 88' are equal in number to the number of string pins 80, 88' of the particular embodiment, preferably six. Pin holes are vertical, each located equidistantly between compression slots 56, 56' (or between a compression slot 56 and a side 58). Pin holes 88, 88' are at least as deep as the length of threads 82 on string pins 80, 80'. The diameters of pin holes 88, 88' are slightly larger than the inside diameter of the threads 82 of string pins 80, 80', so that string pins 80, 80' may removably, yet securely, be screwed into pin holes 88, 88'. Importantly, pin holes 88, 88' are located as near the back 66 of compression block 54 as feasible while still complying with all the other foregoing locational conditions.

Figure 7:
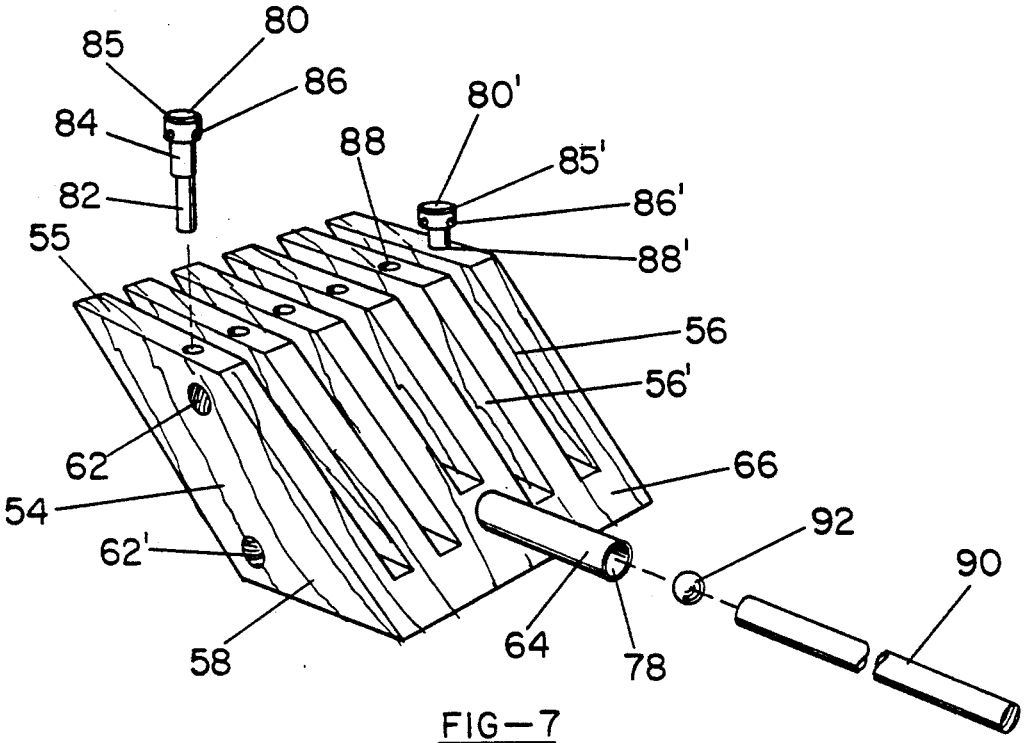
FIG. 7 is an exploded perspective view of the rear of the FIG. 5 embodiment.

Reference is now made to FIGS. 5 and 7. Both figures illustrate the previously described insertion of adjustment screw 74 into screw opening 70, and the insertion of string pins 80, 80' into pin holes 88, 88'. Also illustrated are compression rod 90 and ball bearing 92. Ball bearing 92 is made of steel or other hard material, and has a diameter slightly less than the inside diameter of guide tube 64, thus permitting the easy insertion of ball bearing 92 into guide tube 64. Compression rod 90 is a solid dowel composed of wood or any other inexpensive, rigid material. Compression rod 90 also has a diameter only slightly less than the inside diameter of guide tube 64, such that compression rod 90 may be inserted into the exterior end 78 end of guide tube 64 with a snug, but moveable, fit. The longitudinal axis of the inserted compression rod 90 thus is co-linear with the longitudinal axes of guide tube 64 and screw opening 70. As will be later explained in more detail, the length of compression rod 90 is dependent upon the size of the particular musical instrument to which the apparatus is applied.

Continued reference is made to FIGS. 5 and 7. The assembly of the preferred embodiment of the apparatus entails the insertion of ball bearing 92 into guide tube 64, followed by the insertion of compression rod 90 into guide tube 64. Compression rod 90 is pushed into guide tube 64 until ball bearing 92 contacts compression block 54 at the interior end of guide tube 64 (at its junction with the interior end of screw opening 70) and the interior end of compression rod 90 contacts ball bearing 92. It is thus seen that compression rod 90 is slidably disposed within guide tube 64, such that compression rod 90 and ball bearing 92 are both free to move along the length of guide tube 64 in response to external forces. It shall be seen that, in particular, adjustment screw 74 shall serve as a means for slidably moving compression rod 90 within guide tube 64.

Thus assembled, the preferred embodiment of the apparatus may be installed within the musical instrument as illustrated in FIGS. 6, 8 and 9. Detailed explanation of the installation may best be made first with reference to FIG. 9. In the typical guitar, bridge 46 and top plate 36 are pierced with bridge holes 96, 96' and top plate holes 98, 98', respectively (only one of each shown in FIG. 9). Bridge holes 96, 96' and top plate holes 98, 98' number at least one each in an instrument, but the number corresponds directly to the number of strings 26 on the instrument. A six-string guitar, for example, will have six bridge holes 96, 96' and six top plate holes 98, 98', all normally of the same diameter. As seen in FIG. 9, bridge holes 96, 96' and top plate holes 98, 98' are in alignment, one each of the former above one each of the latter, effectively comprising holes of uniform diameter from the outside of sound box 38 to the inside. Since bridge 46 normally is permanently or semi-permanently affixed to top plate 36, the proper alignment of bridge holes 96, 96' and plate holes 98, 98' is easily maintained. Bridge holes 96, 96' and top plate holes 98, 98' serve the purpose of receiving and holding original stock string pins (not shown).

Brief reference is made to FIGS. 6 and 8. The complete apparatus 52, minus string pins 80, 80', is introduced into the interior of sound box 38 via sound hole 50. It is necessary to remove strings 26 to accomplish the insertion. Original stock string pins (not shown) are removed and set aside, as they will be replaced with string pins 80, 80' of the invention. String pins 80, 80' are removed from pin holes 88, 88' and retained for later use. Alternatively, the complete apparatus 52 may be integrated into the instrument at time of manufacture.

With renewed reference to FIG. 9, it is seen that the preferred embodiment of the apparatus is removably attached to the interior side of top plate 36. The apparatus to be used must have pin holes 88, 88' equal in number to the number of bridge holes 96, 96' in the subject instrument. Proper positioning of the apparatus is accomplished by placing the top 55 of compression block 54 against the interior surface of top plate 36, with the front 72 of compression block 54 nearer sound hole 50, and the back 66 nearer tail block 100. Viewing compression block 54 through the bridge holes 96, 96', the user of the invention aligns pin holes 88, 88' with corresponding bridge holes 96, 96' of the instrument.

With the apparatus so positioned, or in the course of attempting to so position the apparatus, the proper length of compression rod 90 may be ascertained. The proper length of compression rod 90 is such that, with the apparatus properly positioned as described above, compression rod 90 contacts tail block 100 while simultaneously extending into guide tube 64 at least one-third—but preferably no more than seven-eighths—the length of guide tube 64. Contact between compression rod 90 and tail block 100 is essential for the installed apparatus to function properly. With a minor amount of positional and observational effort, an acceptable length of the compression rod 90 is determined. With the apparatus removed from the interior of sound box 38, the compression rod 90 may then be removed from guide tube 64 and cut to acceptable length to customize the apparatus to the particular instrument. Experience indicates that the finished length of compression rod 90 typically is approximately one inch shorter than the distance from the bridge holes 96, 96' to the butt 102 of the instrument.

An advantage of the present invention is here noted. A single apparatus of the invention may be adapted for use in more than one particular instrument by utilizing an assortment of compression rods of customized lengths. The user need only match a given instrument with a compression rod of an appropriate corresponding length. By selecting a compression rod of a length suited to the size of another instrument, the user may readily remove the apparatus from one instrument and install it in another (especially if both instruments have the same number of strings).

With compression rod 90 fashioned to an acceptable length, the assembled apparatus is again placed within sound box 38 and positioned as described above. (If compression rod 90 is yet too long to permit proper positioning, the apparatus is again removed from the instrument and the rod shortened accordingly). The apparatus is removably attached to the interior of the instrument using string pins 80, 80'. String pins 80, 80' are inserted through bridge holes 96, 96' and top plate holes 98, 98', and then into pin holes 88, 88' in compression block 54. Care is exercised to assure that string pins 80, 80' are inserted in a locational order according to string size, such that string holes 86, 86' in string pins 80, 80' properly accommodate corresponding strings. String pins 80, 80' are then screwed, by hand or with a tool, into pin holes 88, 88' until string pins 80, 80' are "finger tight." This screwing will have the effect of drawing top 55 of compression block 54 firmly against the interior side of top plate 36, thus removably securing the apparatus within the instrument.

As illustrated in FIGS. 4 and 7, compression slots 56, 56', coupled with the flexible elasticity of the material of compression block 54, permit a measure of flexibility in the distances between various pin holes 88, 88'. This flexibility in turn allows the apparatus to be accommodated to an instrument with minor variations in distances between its bridge holes 96, 96'. Similarly, such flexibility also allows the apparatus to be used in two or more instruments with differing distances between bridge holes.

Combined reference is made to FIGS. 5 and 9. With the apparatus attached within the instrument, its purpose may be accomplished through the manipulation of adjustment screw 74. As adjustment screw 74 is screwed into screw opening 70 in compression block 54, it extends an ever greater distance into screw opening 70; eventually, with continued turning of adjustment screw 74, screw tip 108 will emerge into the interior end of guide tube 64, where ball bearing 92 is situated. Continued turning of adjustment screw 74 causes it to exert a force upon ball bearing 92, which force is then transmitted to compression rod 90 as ball bearing 92 contacts compression rod 90 within guide tube 64. The force thus exerted upon compression rod 90 causes compression rod 90 to go into compression, which results in the imposition of a compressive force upon tail block 100 where it is contacted by compression rod 90. Ball bearing 92 prevents adjustment screw 74 from screwing into and splitting the end of compression rod 90.

Once the foregoing several contacts are made and maintained, the further turning of adjustment screw 74 tends to cause a displacement, relative to the instrument, of compression block 54, rather than further displacement of adjustment screw 74. Excepting a minor reduction in the length of compression rod 90 due to compressive loading, additional turning of adjustment screw 74 tends to cause elastic deformation in compression block 54, as the entire apparatus pushes with increasing force against tail block 100, while compression block 54 is simultaneously prohibited from lateral movement by its attachment at string pins 80, 80'.

The described forces created by the turning of adjustment screw 74 thus cause a minute rotary deformation, clockwise as viewed in FIG. 9, in compression block 54, as compression rod 90 pushes ever harder against tail block 100. Such deformation, which is controlled by the turning of adjustment screw 74, is about an imaginary axis or fulcrum generally defined by the points where the centers of string pins 80, 80' pass through the plane of top plate 36. A direct consequence of this deformation is a corresponding outward compressive force C exerted by the top 55 of compression block 54 upon the interior of top plate 36, between sound hole 50 and string pins 80, 80'. It is seen that force C is opposed to moment of force M (and its equivalent couple, forces F and F'). This opposition counteracts moment of force M, and neutralizes or overcomes its effects.

Reference is made to FIGS. 8 and 9. It is noted that compression block 54 is situated within sound box 38 so that compression block 54 is not symmetrically aligned directly beneath bridge 46 or string pins 80, 80'. String pins 80, 80', bridge holes 96, 96', top plate holes 98, 98' and pin holes 88, 88' are in true alignment. Relative to bridge 46 and string pins 80, 80', however, compression block 54 is shifted toward the head 28 of the instrument. More specifically, compression block 54 is installed so that the greater portion of its top 55 is located between string pins 80, 80' and sound hole 50, with only a minor remainder of top 55 contacting top plate 36 between string pins 80, 80' and butt 102. This offset position of compression block 54 maximizes the distance between string pins 80, 80' and the locus of compressive force C (i.e., the moment arm of compressive force C)—with the beneficial result that the magnitude of compressive force C may be minimized without reducing the effectiveness of the invention. The rhomboid vertical section of compression block 54, and the location of pin holes 88, 88' in the compression block, foster this result. (To further aid an understanding of the function of the invention, it is noted that the minor portion of top 55 which contacts top plate 36 between string pins 80, 80' and butt 102 will tend slightly to depart, or pull away, from top plate 36 as compression block 54 is deformed.)

The magnitude of compressive force C may be controlled by the turning of adjustment screw 74, which is accessed through sound hole 50. When adjustment screw 74 has not been turned into screw opening 70 a sufficient distance to make contact with ball bearing 92, no compression is created in compression rod 90, no deformation of compression block 54 results, and no compressive force C is created. After adjustment screw 74 has been turned into screw opening until its tip 108 contacts ball bearing 92, which then contacts compression rod 90, further turning of adjustment screw 74 advances its tip 108 into guide tube 64. Such advancement increases the compression of compression rod 90, which results in an increase in compressive force C. The user, by careful manipulation of adjustment screw 74, thus may gradually increase compressive force C until moment of force M is neutralized (which arrests further warpage of top plate 36), or even until moment of force M is overcome (which may reverse and remove existing warpage).

Reference is now made to FIGS. 6, 8 and 9. With the apparatus attached within the instrument, strings 26 are then reattached to the instrument in a conventional manner, using string pins 80, 80' and the string holes 86, 86' therein. Strings 26 may be tightened by turning tuning keys 34, or by turning tuning keys 34 and string pins 80, 80'. Tuning of each string is accomplished with tuning keys 34. A person of ordinary skill in the art can use the richness of the instrument's tone and the overall quality of its sound to determine whether adjustment screw 74 has properly been set, since the reduction in warpage in top plate 36 shall improve the sound of the instrument. After reattaching strings 26 and tuning the instrument, the user may discover that the sound of the instrument suggests further manipulation of adjustment screw 74 is needed.

Adjustment screw 74 may, of course, be turned in reverse and screwed back out of screw opening 70. This will reduce or eliminate compression in compression rod 90. As compression block 54 preferably is made of a resilient material, reducing any compression in compression rod 90 will cause compression block 54 to tend to spring back to its undeformed configuration, reducing or eliminating compression force C. Again, by alternatively adjusting screw 74 and listening to the sound of the instrument, one skilled in the art can ascertain when compressive force C has been set at the proper magnitude to satisfactorily remediate or prevent warpage in top plate 36. Care is taken not to overscrew adjustment screw 74, which may cause breakage of compression rod 90.

When properly installed, the preferred embodiment of the apparatus of the invention is nearly invisible from outside the instrument; upon casual inspection of the instrument, only adjustment screw 74 may be visible through sound hole 50. An advantage of the preferred embodiment of the invention is that no part of the invention protrudes from the instrument to mar its appearance. (String pins 80, 80' are readily visible, of course, but are a normal, necessary elements of the instrument and are preferably fashioned of attractive brass.) The rhomboid vertical section shape of the compression block 54 of the preferred embodiment, as illustrated in FIG. 2, enhances this invisibility feature of the invention, as well as maximizing the length of top 55 of compression block 54 to increase the functional effectiveness of the invention.

Figure 10:
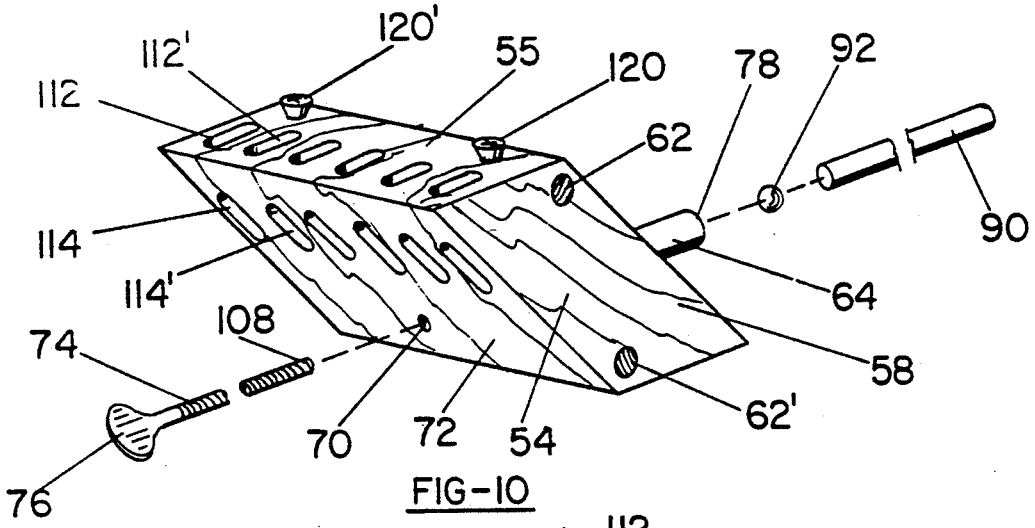
FIG. 10 is an exploded perspective view of the front of a first alternative embodiment of the apparatus of the invention, showing the positional relationship of various elements of the embodiment.
Figure 11:
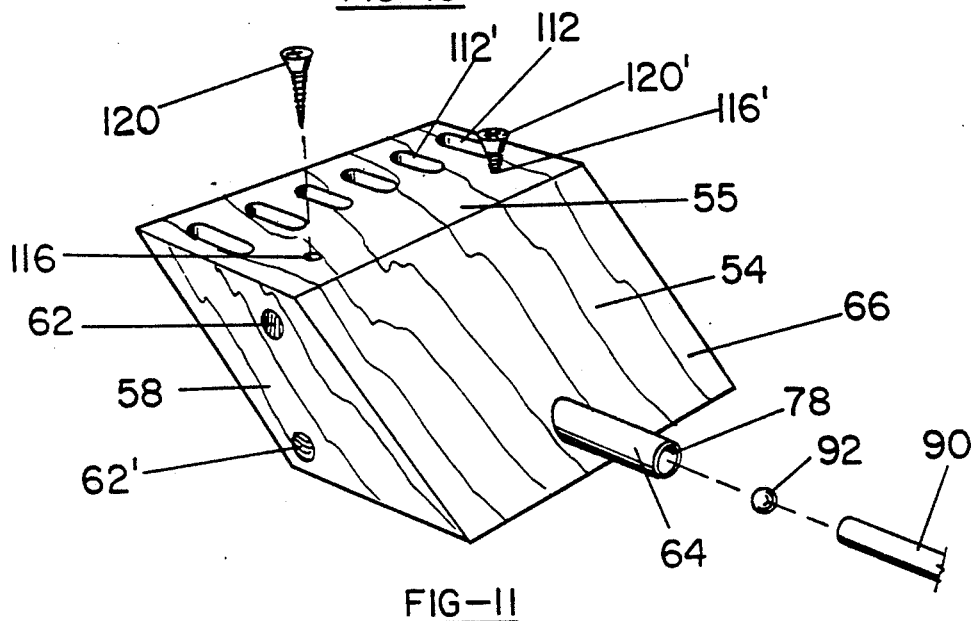
FIG. 11 is an exploded perspective view of the rear of the FIG. 10 embodiment.

Reference is made to FIGS. 10 and 11, which illustrate a first alternative embodiment of the apparatus of the invention. This first alternative embodiment functions essentially in the same way as the preferred embodiment; it is distinguished from the preferred embodiment primarily by the manner in which it is attached to the interior of the instrument. Many acoustical guitars have two bridge screw holes (not shown) in their bridges, which holes penetrate the instrument's top plate. These bridge screw holes are commonly located the same distance apart, with little or no variation in the distance from instrument to instrument. The first alternative embodiment exploits this common feature.

While not depicting the first alternative embodiment, FIG. 9 fosters an understanding of its application. The bridge 46 of many a guitar is fastened to the instrument's top plate 36 with two bridge screws (not shown) (often in combination with adhesives or other fastening devices). These bridge screws vertically pierce bridge 46 and top plate 36 via the pair of bridge screw holes (not shown). Bridge screw holes are normally located such that the saddle 44 and string pins 80, 80' of the instrument are between the bridge screw holes and sound hole 50. Bridge screw holes are located one each on either side of the longitudinal axis of the instrument, equal distances from that axis.

Reference is again made to FIGS. 10 and 11. It is noted that the first alternative embodiment of the apparatus comprises many of the elements and features of the preferred embodiment. Illustrated is compression block 54, with top 55, front 72, back 66 and sides 58, 58', as described for the preferred embodiment. Also shown are adjustment screw 74, screw opening 70, reinforcing dowels 62, 62', guide tube 64, ball bearing 92 and compression rod 90, all identical to, and serving the same functions as, the corresponding elements of the preferred embodiment as described hereinabove.

In the first alternative embodiment, compression block 54 has no compression slots or pin holes. Compression block 54 is, however, penetrated by pin channels 112, 112'. Pin channels 112, 112' number at least one, and correspond in number to the number of strings on the instrument to which the apparatus shall be applied. Pin channels 112, 112' are vertical, and parallel to each other and to sides 58, 58'. All pin channels 112, 112' are generally oval or ellipsoid in horizontal section, said ellipsoids having major axes twice as long as their minor axes. Pin channels 112, 122' are drilled or otherwise formed in top 55 of compression block 54, and are sufficiently deep as to penetrate completely compression block 54 and create pin exits 114, 114' in front 72.

Having continued reference to FIGS. 10 and 11, as well as FIG. 9, it is seen that compression block 54 contains attachment screw holes 116, 116' drilled vertically in top 55. Attachment screw holes 116, 116' accommodate attachment screws 120, 120'. Attachment screws 120, 120' are of sufficient length as to pass through the combined thicknesses of bridge 46 and top plate 36 and screw into attachment screw holes 116, 116' so as to secure firm purchase within compression block 54. The precise location of, and distance between, attachment screw holes 116, 116' is based upon and equal to the bridge screw holes of the particular instrument.

The bridge screws are removed from bridge 46 and set aside. The first alternative embodiment of the apparatus, minus attachment screws 120, 120', then is introduced into the interior of the instrument in generally the same way as the preferred embodiment, i.e., by removing strings 26 from the instrument and passing the apparatus through sound hole 50 (as seen in FIGS. 6, 8 and 9). The first alternative embodiment is positioned and installed within the interior of sound box 38 in the same manner as the preferred embodiment, except that attachment to the instrument is secured using attachment screws 120, 120' in lieu of string pins. Upon aligning attachment screw holes 116, 116' with bridge screw holes, the user inserts attachment screws 120, 120' through bridge screw holes and into attachment screw holes 116, 116'. Attachment screws 120, 120' are then turned into attachment screw holes 116, 116' until top 55 of compression block 54 is drawn firmly up against the interior side of top plate 36. Installation of the apparatus is otherwise completed as described for the preferred embodiment. Manipulation of adjustment screw 74 operates to fulfill the purpose of the invention precisely as so described.

The first alternative embodiment of the apparatus may alternatively be installed by drilling all-new holes through the bridge 46 and top plate 36, using a drilling template corresponding to the configuration of the attachment screw holes 116, 116' of the apparatus. Also, the first alternative embodiment of the apparatus may simply be glued into place, using an adhesive and clamps suited to this purpose.

The instrument is then restrung. When practicing the first alternative embodiment of the apparatus of the invention upon a suitable instrument, original stock string pins (not shown) are inserted in the appropriate locations through bridge 46. Pin channels 112, 112' and pin exits 114, 114' accommodate the normal insertion of original stock string pins and accompanying string balls known in the art.

Figure 12:
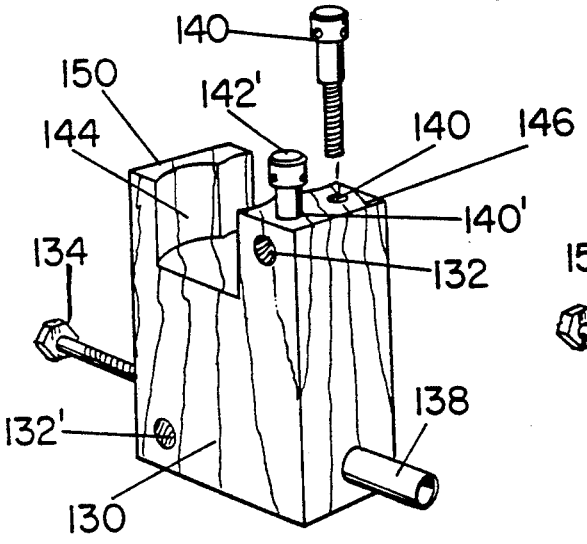
FIG. 12 is a perspective view of a second alternative embodiment of the apparatus of the invention.
Figure 13:
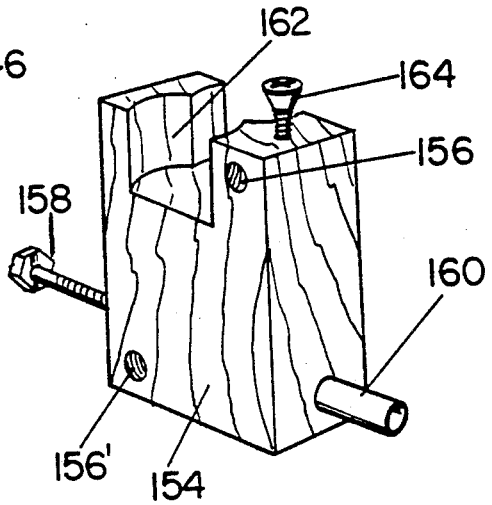
FIG. 13 is a perspective view of a third alternative embodiment of the apparatus of the invention.

Reference is now made to FIGS. 12 and 13, showing other alternative embodiments of the invention. These alternative embodiments have two alternative purposes and advantages: they are especially adapted for use in guitars having more than six strings (twelve strings being customary), and they may be used singly or in combination to customize the invention to a specific warpage problem in a particular instrument. In the case of instruments having more than six strings, the user is able to select any number of alternative embodiments of the apparatus (up to one apparatus for each string) for installation in the instrument. A musician may, for instance, satisfactorily install three alternative embodiments within his or her twelve-string guitar—one apparatus beneath each outside string, and one apparatus beneath an inside string. Also, in the event the warpage in the top plate of an instrument having any number of strings is highly localized, or of an unusual configuration, one or more alternative embodiments may be strategically placed in order to focus the application of the remedial compressive forces where they are most needed.

Having reference to the foregoing description of the preferred and first alternative embodiments of the apparatus, the function and application of the alternative embodiments is readily apparent to one skilled in the art. Simply stated, the alternative embodiment of FIG. 12 is a two-string version of the preferred embodiment, and the embodiment of FIG. 13 is a modified version of the first alternative embodiment. (It is observed that unless additional bridge screw holes are drilled into the bridge of the instrument, the embodiment of FIG. 13 is limited in application to two apparatuses per instrument.)

Specific reference is made to FIG. 12. The embodiment of this figure is installed and functions very similarly to the preferred embodiment described above. The embodiment comprises compression block 130 similar to the identically named element in the preferred embodiment. Also shown are reinforcing dowels 132, 132', adjustment screw 134, guide tube 138, pin holes 140, 140' and string pins 142, 142' substantially identical to their counterparts in the preferred embodiment. Compression block 130 has a gap 144 across its top 146, the purpose of which is to focus the remedial compressive force created by the invention at the top of flat prong 150. Not shown in FIG. 12 are ball bearing and compression rod, which are substantially identical to and serve the same purposes as their counterparts in the preferred embodiment.

One or more embodiments of FIG. 12 are positioned and installed in the instrument using substantially the same methods and procedures as with the preferred embodiment. Manipulation of adjustment screw 134 causes compression in compression rod, which is butted against the tail block of the instrument. The resulting deformation of compression block 130 causes a remedial compressive force to be exerted through flat prong 150 against the appropriate inside surface of the top plate, very similarly to the function of the preferred embodiment.

Reference is made to FIG. 13, showing an alternative embodiment analogous to the first alternative embodiment described hereinabove. The embodiment of FIG. 13 comprises compression block 154, reinforcement dowels 156, 156', adjustment screw 158, guide tube 160, gap 162 and attachment screw 164. Not shown are ball bearing and compression rod. The elements of the embodiment of FIG. 13 are formed and function identically or analogously to their counterparts in the above-described embodiments. With reference to all the foregoing, one of ordinary skill in the art shall understand how to practice the embodiment of the apparatus of the invention depicted in FIG. 13 without further explanation.

Although the invention has been described with reference to these embodiments, other embodiments can achieve the same results. Variations and modifications of the present invention will be obvious to those skilled in the art and it is intended to cover in the appended claims all such modifications and equivalents.

What is claimed is:

1. An apparatus for reversing and preventing warpage in the top plate of a stringed musical instrument, comprising:

a resilient compression block;

means for attaching said compression block to the interior side of the top plate of the instrument;

a compression rod moveably disposed between said compression block and a tail block of the instrument;

means for directing contact between said compression rod and said compression block; and means for adjusting the movement of said compression rod relative to said compression block.

2. An apparatus in accordance with claim 1, wherein said compression block comprises a rhomboid vertical cross-section.

3. An apparatus in accordance with claim 1, wherein said compression block further comprises at least one string pin opening.

4. An apparatus in accordance with claim 1, wherein said compression block further comprises at least one compression slot permitting added lateral flexibility in said compression block.

5. An apparatus in accordance with claim 1, wherein said attaching means comprises means for removably attaching said compression block to the interior side of the top plate of the instrument.

6. An apparatus in accordance with claim 5, wherein said removably attaching means comprises at least one string pin.

7. An apparatus in accordance with claim 6, wherein said string pin comprises at least one opening to accept a string.

8. An apparatus in accordance with claim 7, wherein said opening comprises a diameter corresponding to said string.

9. An apparatus in accordance with claim 6, wherein said string pin is threaded.

10. An apparatus in accordance with claim 5, wherein said attaching means comprises at least one bridge screw.

11. An apparatus in accordance with claim 1, wherein said directing means comprises a guide tube, mounted upon said compression block, having an inside diameter greater than the diameter of said compression rod.

12. An apparatus in accordance with claim 11, wherein said directing means further comprises a ball bearing having a diameter smaller than the inside diameter of said guide tube.

13. An apparatus in accordance with claim 1, wherein said adjusting means comprises means for inducing compression in said compression block and said compression rod.

14. An apparatus in accordance with claim 13, wherein said adjusting means is a screw.

15. A string pin for a stringed musical instrument comprising:

a head, a rotatable about a rotational axis;

a shank;

at least two cylindrical tunnels, completely transecting said head perpendicularly to said rotational axis, one tunnel for accommodating the instrument's string and another tunnel for accommodating a tool useful for turning said string pin.

16. An apparatus in accordance with claim 15 wherein said cylindrical tunnels comprise diameters corresponding to the instrument's string.

17. An apparatus in accordance with claim 15 wherein said tunnels transect said head along perpendicular diameters of said head.

18. A method for reversing and preventing warpage in the top plates of stringed musical instruments comprising the steps of:

a) attaching a resilient compression block to the interior side of the top plate of the instrument;

b) moveably disposing a compression rod between the compression block and a tail block of the instrument;

c) directing contact between the compression block and the compression rod; and d) adjusting the movement of the compression rod relative to the resilient compression block.

19. The method of claim 18 wherein the step of attaching the compression block comprises the step of removably attaching the compression block to the interior side of the top plate of the instrument.

20. The method of claim 19 wherein the step of removably attaching the compression block comprises the step of inserting at least one string pin through the top plate and into a string pin opening in the compression block.

21. The method of claim 19 wherein the step of removably attaching the compression block comprises the step of screwing at least one bridge screw through the top plate and into a bridge screw opening in the compression block.

22. The method of claim 18 wherein the step of directing contact between the compression block and the compression rod comprises the step of mounting a guide tube in the compression block.

23. The method of claim 22 wherein the step of directing contact between the compression block and the compression rod comprises the step of inserting the compression rod into the guide tube.

24. The method of claim 23 wherein the step of directing contact between the compression block and the compression rod comprises the step of disposing a ball bearing within the guide tube.

25. The method of claim 18 wherein the step of adjusting the movement of the compression rod comprises the step of turning a screw.

26. The method of claim 25 wherein the step of turning the screw comprises the step of turning the screw through the resilient compression block to induce compression in the compression rod and in the compression block.

27. The method of claim 26 wherein the step of turning the screw through the compression block to induce compression in the compression rod and in the compression block comprises the step of inducing compression upon the interior side of the top plate.

* * * * *